US011982099B2

(12) United States Patent
Cheng et al.

(10) Patent No.: US 11,982,099 B2
(45) Date of Patent: May 14, 2024

(54) BOTTOM CORNER DAMPER WITH DISPLACEMENT AMPLIFICATION FUNCTION AND FABRICATED TYPE SHEAR WALL WITH ROCKING ENERGY DISSIPATION

(71) Applicant: Beijing University of Technology, Beijing (CN)

(72) Inventors: Yang Cheng, Beijing (CN); Haoxiang He, Beijing (CN); Haoding Sun, Beijing (CN); Bingji Lan, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 5 days.

(21) Appl. No.: 17/892,050

(22) Filed: Aug. 20, 2022

(65) Prior Publication Data

US 2023/0055344 A1 Feb. 23, 2023

(30) Foreign Application Priority Data

Aug. 20, 2021 (CN) ..... 202110958476.6

(51) Int. Cl.
*E04H 9/02* (2006.01)
*E04B 1/98* (2006.01)

(52) U.S. Cl.
CPC ..... *E04H 9/0235* (2020.05); *E04B 1/98* (2013.01); *E04H 9/021* (2013.01); *E04H 9/0215* (2020.05); *E04H 9/0237* (2020.05); *E04H 9/027* (2013.01)

(58) Field of Classification Search
CPC ..... E04B 1/98; E04H 9/021; E04H 9/027; E04H 9/0215; E04H 9/0235; E04H 9/0237
See application file for complete search history.

(56) References Cited

U.S. PATENT DOCUMENTS 6,601,350 B1 * 8/2003 Isoda ..... E04H 9/0235 52/167.2
9,885,175 B1 * 2/2018 Izumi ..... E04H 9/0237
10,479,652 B2 * 11/2019 Evans ..... B66B 23/00
(Continued)

FOREIGN PATENT DOCUMENTS

CN 102787678 A * 11/2012
CN 104847033 A * 8/2015
(Continued)

*Primary Examiner* — Jessie T Fonseca
(74) *Attorney, Agent, or Firm* — PORUS IP LLC

(57) ABSTRACT

A bottom corner damper with a displacement amplification function and a fabricated type shear wall with rocking energy dissipation are provided. The fabricated type shear wall with rocking energy dissipation is composed of a precast shear wall, upper connecting plates, middle connecting plates, lower connecting plates, bent steel plates, bolts, upper support arms, lower support arms, connectors, lead screws, cylinder barrels, viscous fluids, and propellers. A fabricated type shear wall structure, where novel dampers with displacement amplification and steering functions are installed at weak parts of the bottom of the shear wall, the novel dampers are composed of bending energy dissipation dampers, displacement amplification and steering devices and viscous energy dissipation dampers, and the novel dampers have the functions of amplifying the displacement and converting force in a vertical direction of the structure into force in a horizontal direction for transmission.

8 Claims, 2 Drawing Sheets

(56) References Cited

U.S. PATENT DOCUMENTS

| | | | | |
|---|---|---|---|---|
| 2013/0283709 | A1* | 10/2013 | Christopoulos | E04B 1/98 188/376 |
| 2015/0204097 | A1* | 7/2015 | Chou | E04H 9/024 52/167.1 |
| 2018/0266135 | A1* | 9/2018 | Agha Beigi | E02D 27/34 |
| 2020/0392718 | A1* | 12/2020 | Frazao | E04B 1/2403 |

FOREIGN PATENT DOCUMENTS

| | | | | | |
|---|---|---|---|---|---|
| CN | 104878852 | A | * | 9/2015 | |
| CN | 106320570 | A | * | 1/2017 | E04B 2/56 |
| CN | 109083295 | A | * | 12/2018 | E04B 1/34315 |
| CN | 109403493 | A | * | 3/2019 | E04B 1/98 |
| CN | 109555236 | A | * | 4/2019 | |
| CN | 209323737 | U | * | 8/2019 | E04B 1/98 |
| CN | 209468881 | U | * | 10/2019 | |
| CN | 111622377 | A | * | 9/2020 | |
| CN | 111622377 | A | | 9/2020 | |
| CN | 112482603 | A | * | 3/2021 | E04B 1/38 |
| CN | 112942612 | A | * | 6/2021 | E04B 1/98 |
| CN | 113073748 | A | * | 7/2021 | E04B 1/98 |
| CN | 113073748 | A | | 7/2021 | |
| CN | 113235776 | A | * | 8/2021 | E04B 1/98 |
| CN | 113389291 | A | * | 9/2021 | |

* cited by examiner

BOTTOM CORNER DAMPER WITH DISPLACEMENT AMPLIFICATION FUNCTION AND FABRICATED TYPE SHEAR WALL WITH ROCKING ENERGY DISSIPATION

CROSS REFERENCE TO THE RELATED APPLICATIONS

This application is based upon and claims priority to Chinese Patent Application No. 202110958476.6, filed on Aug. 20, 2021, the entire contents of which are incorporated herein by reference.

TECHNICAL FIELD

The present invention belongs to the technical field of seismic shock absorption of civil engineering structures, and particularly relates to a bottom corner damper with a displacement amplification function and a fabricated type shear wall with rocking energy dissipation.

BACKGROUND

With the continuous and rapid development of the national economy, the steady growth of the construction market, the increasingly high requirements for green economy, energy conservation and environmental protection, and the increasing labor costs caused by the aging of the social population, these factors have led to the development of the construction industry facing the pressure of environmental protection and energy conservation. Compared with a traditional cast-in-place reinforced concrete structure, a fabricated type concrete shear wall structure has similar functions and comprehensive benefits, but it has higher assembly and construction efficiency and is more resource-saving, and is gradually widely used in construction practice.

Under the action of earthquakes, the large stiffness and self-weight of the shear wall will lead to a large structural response, so that it is in a complex stress state with simultaneous bending, shearing and torsion, which is prone to brittle failure with poor ductility. Earthquake damage and experimental studies show that the damage of shear wall structures mostly occurs at the bottom of a structure with the most unfavorable stress, which is manifested as large exfoliation of concrete and buckling of longitudinal bars, and this damage is difficult to repair. Traditional methods of improving ductility, such as limiting the height of a compression zone of the shear wall, setting end columns, and changing a reinforcement form of the shear wall (coupling beam), can ensure the seismic capacity of the shear wall to a certain extent, but in essence, at the expense of sacrificing a main structure, it will cause greater economic losses.

To sum up, the installation of dampers in the weak parts of the shear wall structures has become a research hotspot to improve the seismic performance of the structures. However, due to the complex stress of the shear wall, the installed dampers often fail to sufficiently dissipate energy.

SUMMARY

In order to solve the above problems, the present invention provides a bottom corner damper with a displacement amplification function and a fabricated type shear wall with rocking energy dissipation. The fabricated type shear wall is adopted to conform to the concept of environmental protection, the designed bottom corner damper with the displacement amplification function may play different roles according to different stress states under the action of earthquakes, when the shear wall is mainly damaged by bending, bending energy dissipation dampers play a main role, and when the shear wall is mainly damaged by shearing, viscous energy dissipation dampers dissipate shearing force in a horizontal direction. During bending and shearing damage, the bending energy dissipation is performed by the bending energy dissipation dampers first, and after displacement amplification and steering devices amplify upper displacement and convert vertical acting force into rotation force in the horizontal direction, the viscous dampers perform energy dissipation.

In order to implement the above objective, the present invention adopts the following technical solutions.

A bottom corner damper with a displacement amplification function and a fabricated type shear wall with rocking energy dissipation are provided. The fabricated type shear wall with rocking energy dissipation is composed of a precast shear wall (1), upper connecting plates (2), middle connecting plates (3), lower connecting plates (4), bent steel plates (5), bolts (6), upper support arms (7), lower support arms (8), connectors (9), lead screws (10), cylinder barrels (11), viscous fluids (12), and propellers (13). The upper connecting plates (2), the lower connecting plates (4) and the cylinder barrels (11) are directly connected to the precast shear wall (1), the upper connecting plates (2), the bent steel plates (5), and the middle connecting plates (3) are connected by welding to form bending energy dissipation dampers, and under the action of earthquakes, when the shear wall is bent and deformed, energy generated by the bending deformation is dissipated by the bending energy dissipation dampers. The middle connecting plates (3), the lower support arms (8) and the upper support arms (7) are connected through the bolts (6), the upper support arms (7) and the lower support arms (8) are connected to the lead screws (10) through the connectors (9) to form displacement amplification and steering devices, when the bending energy dissipation dampers perform energy dissipation, generated acting force is downwards transmitted through the middle connecting plates (3), the upper support arms (7) connected to the middle connecting plates (3) through the bolts (6) and the lower support arms (8) begin to stretch to both sides under the action of the force, and the connectors (9) are driven to move synchronously. At this time, the lead screws (10) rotate at an accelerated rate under the action of the connectors (9), amplify upper displacement, and at the same time convert acting force in a vertical direction into rotation in the horizontal direction. The propellers (13) are attached to end portions of the lead screws (10), the propellers (13) extend into the cylinder barrels (11) containing the viscous fluids (12) to form the viscous energy dissipation dampers, and the lead screws (10) drive the propellers (13) to rotate in the viscous fluids (12), so as to produce viscous damping and dissipate seismic energy.

The bolts (6), the upper support arms (7), the lower support arms (8), and the connectors (9) are all made of high-strength steel Q460, so as to ensure stability and safety of connection thereof. Arm lengths and angles of the upper support arms (7) and the lower support arms (8) may be adjusted for installation on site according to actual engineering needs.

Each propeller (13) may be in a form of two-blade or three-blade structure, and a clearance of 1/10-1/5 of a diameter of the cylinder barrel is left between each propeller and the corresponding cylinder barrel, so as to have enough movement space when the propeller moves.

Compared with the prior art, the present invention has the following advantages:

1) According to the bottom corner damper with the displacement amplification function and the fabricated type shear wall with rocking energy dissipation in the present invention, bottom corner dampers with the displacement amplification function and composed of the bending energy dissipation dampers, the displacement amplification and steering devices, and the viscous energy dissipation dampers are reasonably arranged at the weak positions at the bottom of the shear wall, so that the bottom corner dampers with the displacement amplification function dissipate energy according to complex stress state of the shear wall, the bending energy dissipation dampers perform bending energy dissipation, the viscous dampers perform shearing energy dissipation in the horizontal direction, and the bending energy dissipation dampers and the viscous dampers may also work together.
2) According to the bottom corner damper with the displacement amplification function and the fabricated type shear wall with rocking energy dissipation in the present invention, the displacement amplification and steering devices have functions of amplifying displacement and converting acting force in the vertical direction into rotation in the horizontal direction. After the displacement is amplified, the bottom corner dampers with the displacement amplification function may fully dissipate energy, and after changing the direction for energy dissipation, an energy dissipation mode of the bottom corner dampers with the displacement amplification function more conforms to an actual stress state of the shear wall.
3) According to the bottom corner damper with the displacement amplification function and the fabricated type shear wall with rocking energy dissipation in the present invention, the height of the involved displacement amplification and steering devices may be adjusted according to the actual engineering needs, all components may be rapidly assembled and disassembled, and construction and replacement are easy.

In FIGS.: 1—Precast shear wall, 2—Upper connecting plate, 3—Middle connecting plate, 4—Lower connecting plate, 5—Bent steel plate, 6—Bolt, 7—Upper support arm, 8—Lower support arm, 9—Connector, 10—Lead screw, 11—Cylinder barrel, 12—Viscous fluid, and 13—Propeller

DETAILED DESCRIPTION OF THE EMBODIMENTS

Embodiment 1

The detailed description of the present invention will be described in detail below with reference to the accompanying drawings.

Figure 1:
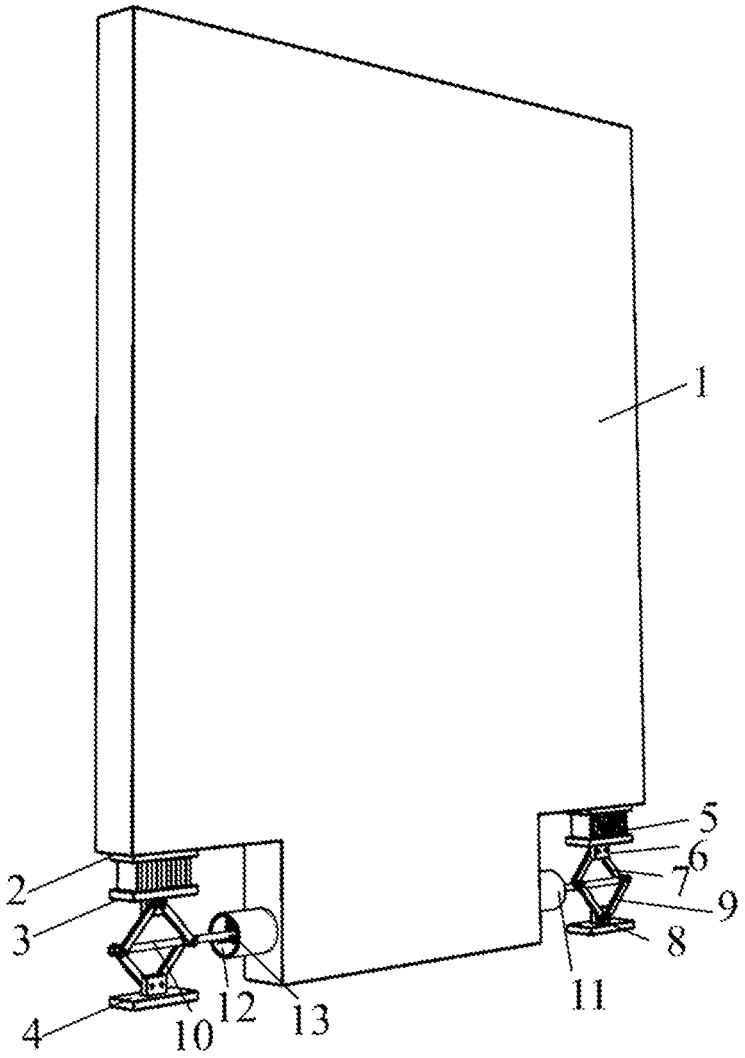
FIG. 1 is a three-dimensional effect diagram of a bottom corner damper with a displacement amplification function and a fabricated type shear wall with rocking energy dissipation according to the present invention.

As shown in FIG. 1 illustrating an embodiment of a bottom corner damper with a displacement amplification function and a fabricated type shear wall with rocking energy dissipation. The fabricated type shear wall with rocking energy dissipation mainly includes a precast shear wall (1), upper connecting plates (2), middle connecting plates (3), lower connecting plates (4), bent steel plates (5), bolts (6), upper support arms (7), lower support arms (8), connectors (9), lead screws (10), cylinder barrels (11), viscous fluids (12), and propellers (13).

Figure 2:
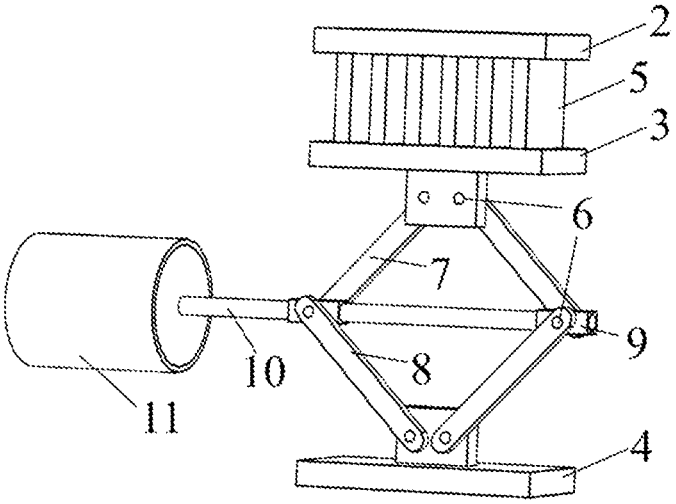
FIG. 2 is a structural diagram of a bottom corner damper with a displacement amplification function and a steering function.
Figure 3:
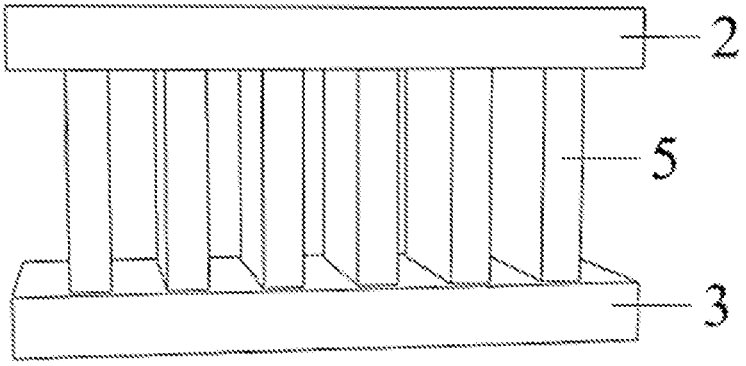
FIG. 3 is a structural diagram of a bending energy dissipation damper.
Figure 4:
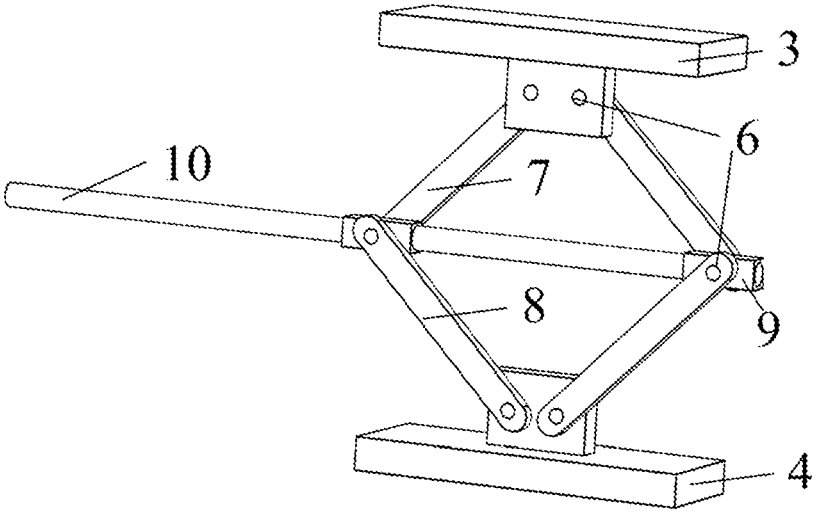
FIG. 4 is a structural diagram of a displacement amplification and steering device.
Figure 5:
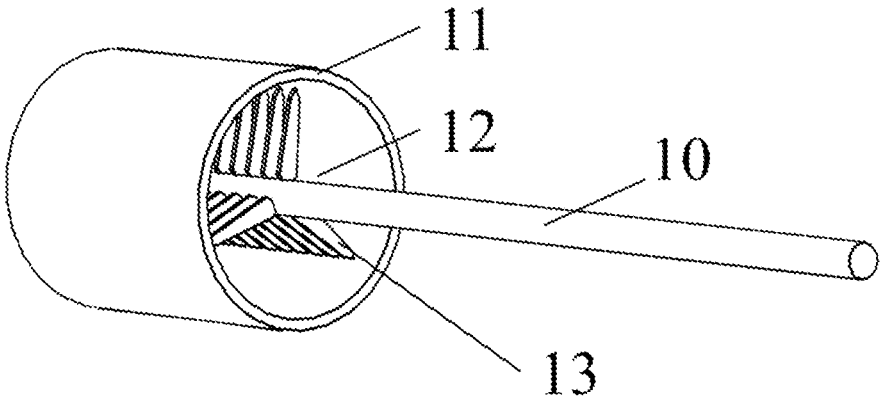
FIG. 5 is a structural diagram of a viscous energy dissipation damper.

Implementation steps are as follows:

1) For a fabricated type shear wall structure, a wall height is 3000 mm, a wall width is 2000 mm, and a wall thickness is 200 mm. A space of 500 mm×400 mm×200 mm is left on each of both sides of the bottom of the shear wall, that is, a total height of the bottom corner damper with a displacement amplification function is 500 mm, a total width is 400 mm, and a total thickness is 200 mm, referring to FIG. 1 and FIG. 2.
2) For bending energy dissipation dampers, energy dissipation steel plates is made of Q235 steel, a size of each energy dissipation steel plate is 15 mm×80 mm×105 mm, and a clearance between the energy dissipation steel plates is 20 mm, referring to FIG. 3. Sizes of the upper, middle and lower connecting plates is 230 mm×22 mm×200 mm, the middle and lower connecting plates have bolt hole plates connected to other components, and a radius of screw holes is 5 mm.
3) For displacement amplification and steering devices, upper and lower arm rods, the bolts and the connectors are made of Q460 steel, a radius of the bolts is 5 mm, a length of the arm rods is 180 mm, an initial included angle between every two arm rods is 90°, a length of the lead screws is 420 mm, a radius of the lead screws is 8 mm, the connectors are square externally and circular internally, an outer size of the connectors is 50 mm×20 mm×36 mm, a cylinder with a radius of 8 mm penetrates through the interior of each connector, and a screw hole with a depth of 10 mm and a radius of 8 mm is reserved in the middle of the length direction of each connector, referring to FIG. 4.
4) For viscous dampers, a length of the cylinder barrels is 150 mm, a wall thickness is 10 mm, the viscous fluids are contained in the cylinder barrels, the propellers are distributed in a three-blade form, a thickness is 2 mm, ten blades are included, and the blades are spaced by 10 mm. A distance between each propeller and an inner wall of the corresponding cylinder barrel is 11 mm, and a distance of 15 mm-20 mm from the top and bottom of the cylinder barrel is reserved, referring to FIG. 5.
5) Under the action of earthquakes, when the shear wall is mainly damaged by bending, the bending energy dissipation dampers play a main role; and when the shear wall is mainly damaged by shearing, the viscous energy dissipation dampers dissipate shearing force in the horizontal direction. During bending and shearing damage, the bending energy dissipation dampers, the viscous energy dissipation dampers and the displacement amplification and steering devices work together, the middle connecting plates, the lower support arms and the upper support arms are connected through the bolts, the upper support arms and the lower support arms are connected to the lead screws through the connectors to form the displacement amplification and steering devices, acting force generated by energy dissipation of the bending energy dissipation dampers is downwards transmitted through the middle connecting plates, the upper support arms connected to the middle connecting plates through the bolts and the lower support arms begin to stretch to both sides under the action of the force, and the connectors are driven to move synchronously. At this time, the lead screws rotate at an accelerated rate under the action of the connectors, amplify displacement of an upper part, and at the same time convert acting force in a vertical direction into rotation in the horizontal direction. The propellers are attached to end portions of the lead screws, the propellers extend into the cylinder barrels containing the viscous fluids to form the viscous energy dissipation dampers, and the lead screws drive the propellers to rotate in the viscous fluids, so as to produce viscous damping and dissipate seismic energy.

The above is a typical embodiment of the present invention, but the implementation of the present invention is not limited thereto.

What is claimed is:

1. A bottom corner damper with a displacement amplification function, wherein the bottom corner damper is fabricated with a precast shear wall with a rocking energy dissipation, and the bottom corner damper comprises upper connecting plates, middle connecting plates, lower connecting plates, bent steel plates, bolts, upper support arms, lower support arms, connectors, lead screws, cylinder barrels, viscous fluids, and propellers; wherein the upper connecting plates, the lower connecting plates and the cylinder barrels are directly connected to the precast shear wall, and each of the upper connecting plates, the bent steel plates, and the middle connecting plates are connected by welding to form bending energy dissipation dampers; when the precast shear wall is damaged by shearing, viscous energy dissipation dampers dissipate a shearing force in a horizontal direction; during a bending and shearing damage, the bending energy dissipation dampers, the viscous energy dissipation dampers and displacement amplification and steering devices work together, the middle connecting plates, the lower support arms and the upper support arms are connected through the bolts, the upper support arms and the lower support arms are connected to the lead screws through the connectors to form the displacement amplification and steering devices, an acting force generated by an energy dissipation of the bending energy dissipation dampers is downwards transmitted through the middle connecting plates, the upper support arms connected to each of the middle connecting plates through the bolts and the lower support arms begin to stretch to two sides under the acting force, and the connectors are driven to move synchronously; the lead screws rotate at an accelerated rate under an action of the connectors, to amplify a displacement of an upper part, and convert the acting force in a vertical direction into a rotation in the horizontal direction; and the propellers are attached to end portions of the lead screws, the propellers extend into the cylinder barrels containing the viscous fluids to form the viscous energy dissipation dampers, and the lead screws drive the propellers to rotate in the viscous fluids to produce a viscous damping and dissipate a seismic energy.

2. The bottom corner damper according to claim 1, wherein the displacement amplification and steering devices are configured to convert a vertical displacement of an upper structure into an accelerated rotation in the horizontal direction.

3. The bottom corner damper according to claim 1, wherein an arm length of each of the upper support arms, an arm length of each of the lower support arms, and an angle between the each of the upper support arms and the each of the lower support arms in each of the displacement amplification and steering devices is configured to be adjusted on site.

4. The bottom corner damper according to claim 1, wherein the upper support arms, the lower support arms, and the lead screws in the displacement amplification and steering devices are connected through the bolts and the connectors.

5. The bottom corner damper according to claim 1, wherein the bolts, the upper support arms, the lower support arms, and the connectors are all made of high-strength steel Q460.

6. The bottom corner damper according to claim 1, wherein each of the propellers is in a form of a two-blade structure or a three-blade structure, and a clearance of 1/10-1/5 of a diameter of each of the cylinder barrels is left between the each of the propellers and a cylinder barrel of the cylinder barrels corresponding to the each of the propellers.

7. The bottom corner damper according to claim 1, wherein a total height of each of the bending energy dissipation dampers is 1/3-1/2 of a total height of each of the displacement amplification and steering devices.

8. The bottom corner damper according to claim 1, wherein a part of each of the lead screws entering each of the cylinder barrels is 1/4-1/3 of a total length of the each of the lead screws.

* * * * *